US010066482B2

(12) United States Patent
Erdmann et al.

(10) Patent No.: US 10,066,482 B2
(45) Date of Patent: Sep. 4, 2018

(54) METHOD AND SYSTEMS FOR INTEGRATING DOWNHOLE FLUID DATA WITH SURFACE MUD-GAS DATA

(71) Applicant: BAKER HUGHES INCORPORATED, Houston, TX (US)

(72) Inventors: Svenja Erdmann, Hannover (DE); Nicklas J. Ritzmann, Celle (DE); Ansgar Cartellieri, Celle (DE)

(73) Assignee: BAKER HUGHES, A GE COMPANY, LLC, Houston, TX (US)

( * ) Notice: Subject to any disclaimer, the term of this patent is extended or adjusted under 35 U.S.C. 154(b) by 125 days.

(21) Appl. No.: 15/146,501

(22) Filed: May 4, 2016

(65) Prior Publication Data

US 2017/0321549 A1 Nov. 9, 2017

(51) Int. Cl.

| | |
|---|---|
| ***E21B 49/08*** | (2006.01) |
| ***E21B 49/10*** | (2006.01) |
| *E21B 7/00* | (2006.01) |

(52) U.S. Cl.

CPC ..... *E21B 49/086* (2013.01); *E21B 49/084* (2013.01); *E21B 49/10* (2013.01); *E21B 7/00* (2013.01); *E21B 2049/085* (2013.01)

(58) Field of Classification Search

CPC .. E21B 49/10; E21B 49/086; E21B 2049/085; E21B 49/084

See application file for complete search history.

(56) References Cited

U.S. PATENT DOCUMENTS

| | | | | |
|---|---|---|---|---|
| 5,277,263 | A * | 1/1994 | Amen | E21B 21/08 175/42 |
| 7,458,227 | B2 | 12/2008 | Lee et al. | |
| 8,714,246 | B2 | 5/2014 | Pop et al. | |
| 2013/0025943 | A1 * | 1/2013 | Kumar | E21B 49/084 175/58 |
| 2015/0285947 | A1 * | 10/2015 | Celepcikay | G01V 3/38 702/7 |

OTHER PUBLICATIONS

Haworth, J.H., Sellens, M., Whittaker, A., 1985. Interpretation of Hydrocarbon Shows Using Light (C1-C5) Hydrocarbon Gases from Mud-Log Data. AAPG Bulletin 69, 1305-1310.

Pixler, B.O., 1969. Formation Evaluation by Analysis of Hydrocarbon Ratios. Journal of Petroleum Technology 21, 665-670. doi:10.2118/2254-PA.

* cited by examiner

*Primary Examiner* — Giovanna C. Wright
*Assistant Examiner* — Kristyn A Hall
(74) *Attorney, Agent, or Firm* — Mossman, Kumar & Tyler, PC

(57) ABSTRACT

A method for evaluating a formation fluid includes the steps of drilling a borehole intersecting a formation with a drill string, circulating a drilling fluid in the wellbore, selectively liberating a formation fluid from the formation, injecting the liberated fluid into the drilling fluid returning to the surface, drawing a sample of the returning drilling fluid at the surface, and estimating at least one parameter of the drawn sample at the surface.

19 Claims, 3 Drawing Sheets

METHOD AND SYSTEMS FOR INTEGRATING DOWNHOLE FLUID DATA WITH SURFACE MUD-GAS DATA

BACKGROUND

1. Field of Disclosure

In aspects, the present disclosure relates to characterizing underground formations and/or features. In further aspects, the present disclosure relates to methods and devices for estimating one or more parameters relating to fluids from a subterranean formation.

2. Description of the Related Art

Wells, tunnels, and other similar holes formed in the earth may be used to access geothermal sources, water, hydrocarbons, minerals, etc. and may also be used to provide conduits or passages for equipment such as pipelines. Such a hole is commonly referred to as a borehole or wellbore of a well and any point within the borehole is generally referred to as being downhole. Boreholes are commonly used in significant capital commercial developments, such as hydrocarbon fields. Therefore, before field development begins, operators desire to have as much information as possible in order to evaluate the reservoir for commercial viability. Such information may be acquired at the seismic exploration phase, during well construction, prior to well completion and/or any time thereafter. A vast amount of the information used for characterizing reservoirs is based directly or indirectly on measurements made in a borehole traversing a hydrocarbon reservoir of interest.

In aspects, the present disclosure is directed to devices, systems and method that may be utilized to obtain or improve information that may be used for characterizing a formation or a formation fluid.

SUMMARY

The present disclosure is directed to a method for evaluating a formation fluid. The method may include the steps of drilling a borehole with a drill string, the borehole intersecting a formation containing the formation fluid, the formation being at a depth uphole of a well bottom; circulating a drilling fluid in the borehole; selectively liberating a fluid from the formation, the liberated fluid including the formation fluid; injecting the liberated fluid into the drilling fluid returning to the surface; drawing a sample of the returning drilling fluid; and estimating at least one parameter of the drawn sample at the surface.

The above-recited examples of features of the disclosure have been summarized rather broadly in order that the detailed description thereof that follows may be better understood, and in order that the contributions to the art may be appreciated. There are, of course, additional features of the disclosure that will be described hereinafter and which will form the subject of the claims appended hereto.

BRIEF DESCRIPTION

For detailed understanding of the present disclosure, references should be made to the following detailed description of the preferred embodiment, taken in conjunction with the accompanying drawings, in which like elements have been given like numerals and wherein.

DETAILED DESCRIPTION

Figure 1:
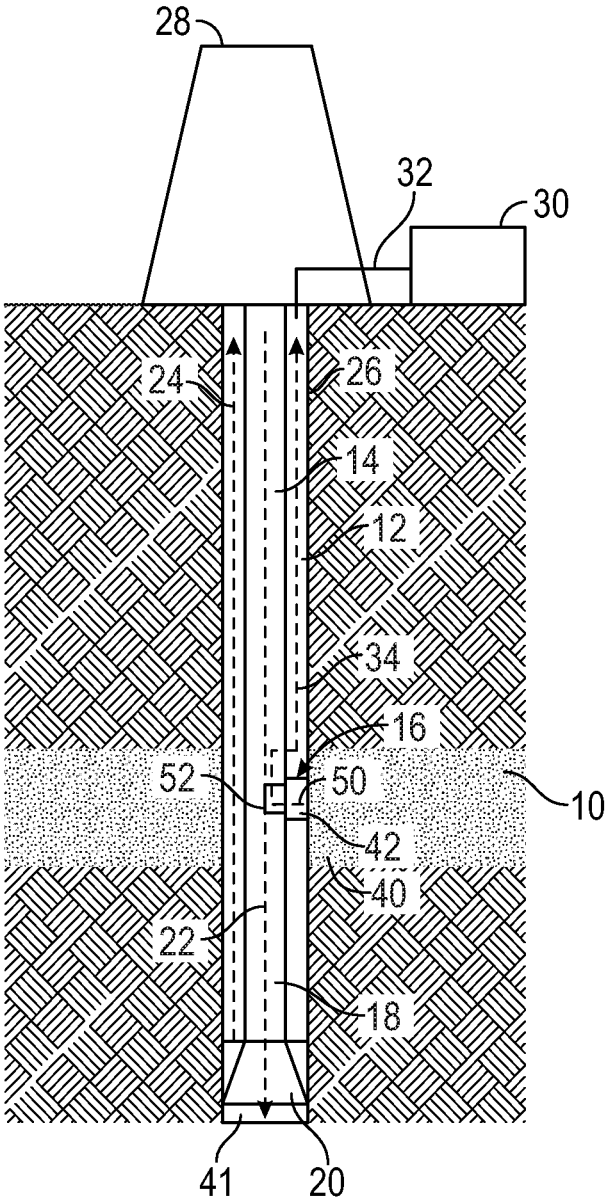
FIG. 1 illustrates a drilling system that may use methodology in accordance with the present disclosure.

The present disclosure relates to devices and methods for gas logging and fluid sampling. Disclosed are methods and related systems wherein gas is selectively liberated at one or more desired depth over a specific time, and measuring the liberated gas with a surface system. Thereafter, "cleanup" gas data may be compared to downhole cleanup sensor data and/or gas data, which was recorded when the rock at the corresponding depth was crushed for the first time. They are shown in the drawings, and herein will be described in detail, specific embodiments of the present disclosure with the understanding that the present disclosure is to be considered an exemplification of the principles described herein, and is not intended to limit the disclosure to that illustrated and described herein. Accordingly, the embodiments discussed below are merely illustrative of the applications of the present disclosure.

In aspects, the teachings of the present disclosure can increase the certainty of the presence of formation fluid types and compositions by implementing a novel gas logging and fluid sampling methodology. Illustrative methods according to the present disclosure involve selectively liberating, for a specified time period, a fluid from a formation, injecting the liberated fluid into a flowing drilling fluid, and monitoring the formation fluid that is pumped to a borehole annulus using surface gas analysis equipment to provide compositional information on the liberated formation fluid in real-time. Optionally, this information may be combined with information on fluid properties from in-situ (downhole) fluid analysis. The gas being analyzed may be a hydrocarbon and/or a non-hydrocarbon (e.g., helium). This information can help inform the decision making early during a well development. Additionally, monitoring the fluid pumped to the annulus may also be used to conduct drilling operations more safely.

Referring initially to FIG. 1, there is schematically represented a cross-section of a subterranean formation 10 in which is drilled a borehole 12. The borehole 12 may be used to access geothermal sources, water, hydrocarbons, minerals, etc. and may also be used to provide conduits or passages for equipment such as pipelines. Conveyed along the borehole 12 by a drill string 14 is a formation evaluation tool 16. At the end of the drill string 14 may be a bottomhole assembly 18. The bottomhole assembly 18 may be configured to drill the borehole 12 by using a drill bit 20. An annulus 26 surrounds the drill string 14. Conventionally, a drilling fluid 22 pumped down the drill string 14 returns as a return fluid 24 via an annulus 26 that surrounds the drill string 14. In some situations, a reverse circulation scheme may be used. In reverse circulation, the fluid is conveyed into the annulus 26 at the surface. This fluid flows downhole and enters the drill string 14 at the well bottom and returns to the surface via a bore (not shown) of the drill string 14. Thus, the returning drilling fluid may flow along the annulus 26 or through the bore of the drill string 14. A rig 28 at the surface may be used to rotate or otherwise handle the drill string 14.

In one non-limiting embodiment, a surface logging system 30 may be used in conjunction with the formation evaluation tool 16 to obtain real-time or near real time information about the fluids in the formation 10. The surface logging system 30 may include a fluid sampling line 32 that is in direct fluid communication with the annulus 26 and one or more instruments configured to analyze one or more components of the return fluid 24. Illustrative instruments include mass spectrometers, gas chromatographs, and other sensors configured to provide chemical, compositional, and physical information regarding the components of the return fluid 24. The surface logging system 30 may include an information processor (not shown), a data storage medium (not shown), display devices, and suitable circuitry for storing and implementing computer programs and instructions. The data storage medium may be any standard computer data storage device, such as a USB drive, memory stick, hard disk, removable RAM, or other commonly used memory storage system known to one of ordinary skill in the art including Internet based storage. The data storage medium may store a program and data collected during the testing process.

The formation evaluation tool 16 may be configured to selectively liberate a fluid from the formation 10. The liberated fluid 34 is released into the annulus 26 and flows upward to the surface as it comingles with the other return fluid 24. If reverse circulation is used, then the liberated fluid 34 is released into the fluid flowing to the surface via a bore of the drill string. The formation evaluation tool 16 may include known devices as a sampling probe 50 and a fluid analysis module 52 that includes one or more pumps, packer(s), and fluid circuitry that can direct pumped fluid into sample tanks and/or the annulus 26. Thus, the fluid flows into the tool 16 via the probe 50 and then exits the tool 16 via a suitable outlet (not shown). The formation evaluation tool 16 may also include sensors for estimating one or more parameters relating to the fluid before the fluid is injected into the annulus. For estimating properties of downhole fluids (naturally occurring or engineered), the formation evaluation tool 16 may include sensors for estimating aromatic content; asphaltene content; bacterial content; bubble point; chemical composition (this overlaps the parameters with the word "content"); color; density; specific gravity; hydrate (gas hydrate) content; naphthenic content; nitrogen content; odor; oxygen content; radioactivity; salt content; solids content; sulfur content; paraffinic content; pH (acidity/alkalinity); phase (defined as gas or liquid); pressure; temperature; viscosity. Illustrative devices include, but are not limited to, fluorescence spectrometers, mass spectrometers, dielectric sensors, optical analyzers, detectors using gas chromatography, ion selective sensors, resonators (e.g., tuning forks), sound speed sensors, refractometers, nuclear magnetic resonance tools, etc.

Figure 2:
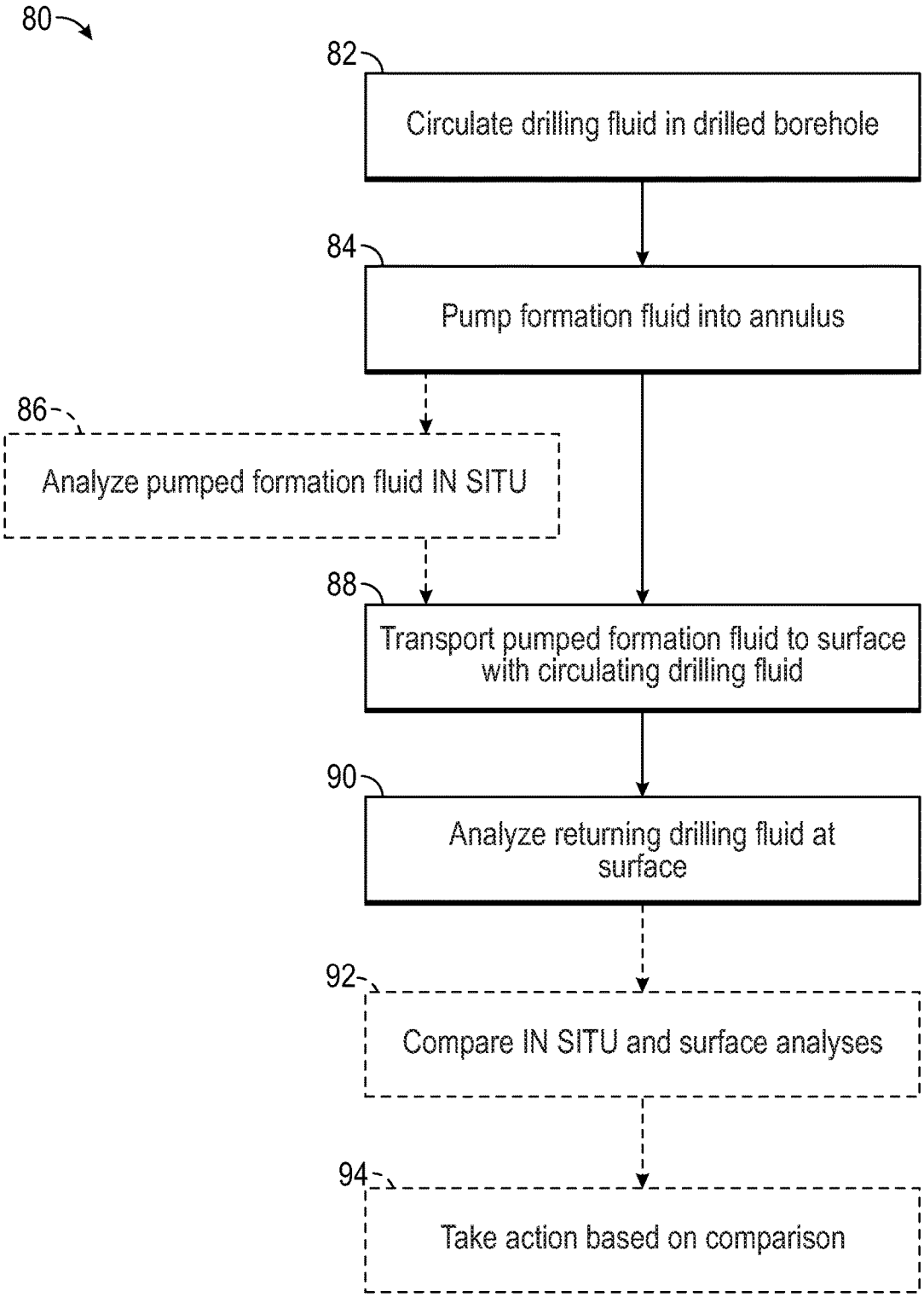
FIG. 2 is a flow chart illustrating one embodiment of a method according to the present disclosure.

One non-limiting method 80 using the teachings of the present disclosure is shown in FIG. 2. Generally, the method includes circulating a drilling fluid at step 82, pumping a formation fluid into the annulus (or bore of a drill string) at step 84, transporting the pumped formation to the surface using the circulating drilling fluid at step 88, and analyzing the returning drilling fluid at the surface at step 90 and optionally taking a responsive action at step 94.

Optionally, the FIG. 2 method may also include the steps of analyzing the pumped formation fluid in situ (i.e., at or close to the location of the pumping) at step 86 and comparing the results of the in situ and surface analyses at step 92.

The FIG. 2 method may be used with the FIG. 1 system. In one implementation, the borehole 12 is drilled using the drill string 14 while the surface gas analysis system 30 generates a log of selected gas parameters by analyzing the returning drilling fluid 24. It should be noted that the log will include gas-related information obtained as the drill bit 20 is crushing the rock and earth at the formation 10. Based on formation evaluation data, gas analysis and/or any other information, a depth or multiple depths for further investigation can be established, a sample depth being labeled depth 40.

Next, the borehole 12 is drilled using the drill string 14 until the formation evaluating tool 16 is at the depth 40. The depth 40 is uphole of a wellbore bottom 41. Drilling is stopped and the probe 50 of the formation evaluation tool 16 is then extended to a borehole wall 42. Upon being energized, the formation evaluation tool 16 pumps fluid from the formation 10 into the annulus 26 while drilling fluid is circulating. In many situations, the drilling mud in the annulus 26 may be at-balanced or over-balanced (i.e., at the same pressure or a greater pressure than the fluid in the formation 10). In other situations, this drilling mud may be under-balanced. It should be noted that the fluid being liberated from the formation 10 at depth 40 is not the fluid being liberated at the wellbore bottom 41 (if such fluid is present). At the same time, one or more sensors (not shown) at the formation evaluation tool 16 may estimate one or more parameters of the pumped fluid before it is ejected into the annulus 26.

During the drilling and throughout the fluid sampling activity, the surface gas analysis system 30 generates a continuous log of one or more gas properties. The circulating drilling fluid transports the liberated fluid 34 to the surface and a sample is drawn using the fluid sampling line 32. The drawn fluid is a mix of the liberated fluid 34 and the return fluid 24. Hydrocarbons and/or non-hydrocarbons from the formation 10 evaporate into gaseous phase at the surface under atmospheric conditions. Depending on the mud, its temperature and hydrocarbon combination, the amount of hydrocarbons in solution may vary and single components may have a different solubility. In one non-limiting arrangement, hydrocarbon extraction is accomplished by feeding the drilling fluid through a vessel with a mechanical agitator and using a vacuum pressure to suck the evaporated hydrocarbons from a headspace of a trap towards the gas logging system 30. Other arrangements such as a membrane system may be used.

Next, the drawn fluid is analyzed by the gas logging system 30. This analysis can be performed by evaluating the released hydrocarbons and non-hydrocarbons using any suitable sensor, such as those described above. Advantageously, the depth at which the liberated fluid 34 enters the annulus 26 is known. Thus, the "lag time," or the time required for the liberated fluid 34 to reach the fluid sampling line 32 can be estimated based on drilling fluid flow rates and other operating parameters. The formation evaluation tool 16 pumps the liberated fluid 34 into the annulus 26 preferably until the readings at the surface stabilize.

Figure 3:
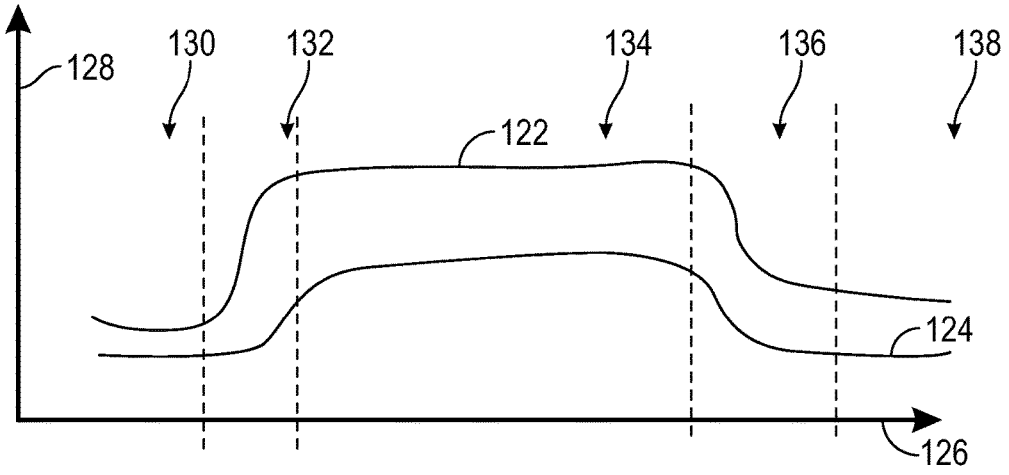
FIG. 3 shows an illustrative plot of gas data generated at the surface according to one embodiment of a method according to the present disclosure.

FIG. 3 shows a graph of illustrative plots 122 and 124 of surface measurement of gas properties. Here, the "X" axis 126 is time (or volume) and the "Y" axis 128 is concentration and/or any compositional ratio. The measurements in FIG. 3 may be considered as having five discrete phases. In the first phase 132, drilling is stopped. In the second and third phases 134, 136 the tool 16 pumps fluid from the formation. During phase 134, there is a transition from mud, via mud filtrate to formation fluid (possibly with some impurities like mud filtrate). During phase 136, there is a stable phase of the cleanup reflecting stable flow from the formation, i.e., the cleanest the pumped fluid can get under the given conditions (formation properties, pump rate, etc.). The pumped fluid may be juvenile formation fluid, and/or a mix of formation fluid and filtrate. During a fourth phase 138, there is a decoupling of the probe 50 from the formation, and the signals return to background reading. The fifth phase 140 is a "normal" background gas data log.

Generally, after correction for lag time, a correlation can be observed from the in situ measurements and the surface measurements at phases 132 and 134 of FIG. 3 because the above-described method provides information based on surface and downhole analysis of the same liberated fluid. This information can be related to composition, concentration, properties, or other parameters of gas in the liberated fluid and associated gas ratios. The downhole/in situ fluid property information may be integrated with mud gas data; e.g., to determine composition of the formation fluid, and/or calibrate mud gas data or vice versa. Also, the surface gas data can be used to calibrate downhole sensors, whereas downhole sensor data from a specific depth can be used to calibrate and verify results of continuous gas measurements on the surface. Calibration can also be performed on the methods during such analyses. Thus, the calibration may be performed on hardware, software, methodologies, and data/information. Still other responsive action may include selecting a formation from which to produce hydrocarbons, isolating one or more formations, bypassing one or more formation, etc.

In a next step this "cleanup" gas data can be compared to downhole cleanup sensor data and/or gas data, which was recorded when the rock at the corresponding depth was crushed for the first time. This comparison may contain information related to depth of invasion of the drilling mud filtrate, thus it could be an invasion monitor.

Another correlation may be made using the gas log data obtained while initially drilling the formation 10 and the information obtained by the formation evaluation tool 16. For example, the gas logs created while the formation was initially being disintegrated by the drill bit 20 may not be overly affected by filtrate invasion into the formation 10. The subsequent combined in situ and surface analysis described above may be compared with the initial gas logs to gain insight into filtrate invasion into the formation 10.

From the above, it should be appreciated that what has been described includes a method for evaluating a formation fluid from a formation. The method may include drilling a borehole with a drill string, the borehole intersecting the formation having the formation fluid, the formation being at a depth uphole of a well bottom; circulating a drilling fluid in the borehole; selectively liberating a fluid from the formation using a fluid sampling tool, the liberated fluid including the formation fluid; injecting the liberated fluid using the fluid sampling tool into the drilling fluid returning to the surface; drawing a sample of the returning drilling fluid at the surface; and estimating at least one parameter of the drawn sample at the surface to generate surface fluid data.

From the above, it should also be appreciated that what has been described includes a system for evaluating a formation fluid. The system may include a drill string configured to drill a borehole intersecting a formation having the formation fluid; a fluid circulation system circulating a drilling fluid in the borehole; a fluid sampling tool conveyed by the drill string, the fluid sampling tool being configured to selectively liberate a fluid from the formation and inject the liberated fluid into a drilling fluid returning to the surface; and a surface logging system configured to estimating at least one parameter of a sample of the returning drilling fluid returning to the surface, the sample being drawn at the surface.

The foregoing description is directed to particular embodiments of the present disclosure for the purpose of illustration and explanation. It will be apparent, however, to one skilled in the art that many modifications and changes to the embodiment set forth above are possible without departing from the scope of the disclosure. Thus, it is intended that the following claims be interpreted to embrace all such modifications and changes.

We claim:

1. A method for evaluating a formation fluid from a formation, comprising:

drilling a borehole with a drill string, the borehole intersecting the formation having the formation fluid, the formation being at a depth uphole of a well bottom;

circulating a drilling fluid in the borehole;

selectively liberating a fluid from the formation using a fluid sampling tool, the liberated fluid including the formation fluid;

injecting the liberated fluid using the fluid sampling tool into the drilling fluid returning to the surface;

drawing a sample of the returning drilling fluid at a surface location; and estimating at least one parameter of the drawn sample at the surface to generate surface fluid data, the drawn sample including the liberated fluid and the returning drilling fluid in which the liberated fluid is mixed.

2. The method of claim 1, wherein the liberated fluid flows into the fluid sampling tool and wherein the liberated fluid is ejected out of the fluid sampling tool.

3. The method of claim 1, wherein the estimating step includes a pumping phase and a decoupling phase.

4. The method of claim 1, further comprising obtaining downhole fluid data by estimating at least one parameter relating to the liberated fluid before the liberated fluid is injected into the returning drilling fluid.

5. The method of claim 4, further comprising: comparing the downhole fluid data with the surface fluid data.

6. The method of claim 5, further comprising: revising, based on the comparison, at least one of: (i) the downhole fluid data, and (ii) the surface fluid data.

7. The method of claim 5, further comprising: calibrating, based on the comparison, at least one of: (i) a downhole instrument, (ii) a surface instrument, (iii) data, and (iv) methodology used to obtain the data.

8. The method of claim 1, wherein the at least one parameter relating to the drawn sample is at least one of: (i) a fluid property, (ii) a fluid composition; and (iii) a physical property.

9. The method of claim 8, further comprising deriving a flow characteristic of the formation.

10. The method of claim 1, wherein drawing the sample of the returning drilling fluid at the surface and estimating at least one parameter of the drawn sample at the surface is performed continuously during drilling wherein rock is crushed at the well bottom with a drill bit and while the fluid is injected into the returning drilling fluid.

11. The method of claim 1, further comprising: generating a gas log while drilling the formation and comparing the generated gas log with downhole fluid data obtained by estimating at least one parameter relating to the liberated fluid before the liberated fluid is injected into the returning drilling fluid.

12. The method of claim 1, wherein the liberated fluid is the formation fluid.

13. The method of claim 1, further comprising evaluating fluid invasion using the estimated at least one parameter.

14. The method of claim 1, further comprising conveying the drawn sample to a gas logging system via a line in fluid communication with the return fluid.

15. The method of claim 1, further comprising collecting an evaporated hydrocarbon from the drawn sample.

16. The method of claim 1, wherein selective liberating and estimating the at least one parameter steps occur at the same time.

17. A system for evaluating a formation fluid, comprising:

a drill string configured to drill a borehole intersecting a formation having the formation fluid;

a fluid circulation system circulating a drilling fluid in the borehole;

a fluid sampling tool conveyed by the drill string, the fluid sampling tool being configured to selectively liberate a fluid from the formation and inject the liberated fluid into a drilling fluid returning to a surface location; and a surface logging system configured to estimating at least one parameter of a sample of the drilling fluid returning to the surface, the sample being drawn at the surface, the drawn sample including the liberated fluid and the returning drilling fluid in which the liberated fluid is mixed.

18. The system of claim 17, wherein the fluid sampling tool includes a probe configured to contact the formation and draw the fluid from the formation and an outlet configured to eject the liberated fluid into the returning drilling fluid.

19. The system of claim 17, wherein the at least one parameter relating to the drawn sample is at least one of: (i) a fluid property, (ii) a fluid composition; and (iii) a physical property.

* * * * *